United States Patent [19]

Pylant

[11] 3,945,527

[45] Mar. 23, 1976

[54] PAINT BRUSH WIPING DEVICE

[76] Inventor: Andrew A. Pylant, 404 N. Columbia St., Warsaw, Ind. 46580

[22] Filed: Oct. 30, 1974

[21] Appl. No.: 519,300

[52] U.S. Cl. ..... 220/90; 220/355

[51] Int. Cl.[2] ..... B65D 25/00; B65D 43/06

[58] Field of Search ... 220/90, 355; 15/423, 104.92; 401/121, 122

[56] References Cited

UNITED STATES PATENTS

| | | | |
|---|---|---|---|
| 557,118 | 3/1896 | Ellis | 220/90 |
| 1,046,694 | 12/1912 | Weander | 220/90 |
| 1,672,624 | 6/1928 | Redifer | 220/90 |
| 1,984,170 | 12/1934 | Archbold, Jr. | 220/90 |
| 2,084,084 | 6/1937 | Greer | 220/90 |
| 2,842,286 | 7/1958 | Beyer | 220/90 |
| 3,133,668 | 5/1964 | Heise | 220/90 |
| 3,693,829 | 9/1972 | Price | 220/90 |
| 3,744,671 | 7/1973 | Saunders, Jr. | 220/90 |

*Primary Examiner*—William Price
*Assistant Examiner*—Allan N. Shoap
*Attorney, Agent, or Firm*—Wendell E. Miller

[57] ABSTRACT

A paint brush wiping device is provided for use with paint cans of the type having a circular lid-attaching portion that comprises inner and outer concentric beads with a friction groove therebetween.

The paint brush wiping device includes a circular rim having a circumferential friction tongue for sealably engaging the friction groove of the paint can.

A wiper blade is attached to the circular rim by means of a web. The wiper blade includes a wiping surface adjacent to a rectangular brush-opening in the device; and the wiper blade includes a wiping edge which is exposed to the rectangular brush-opening.

The rectangular brush-opening provides a first fluid flow path for the return of excess paint to the paint can and a second fluid flow path is provided intermediate of the wiper blade and a proximal portion of the circular rim as a second means of returning excess paint to the paint can.

5 Claims, 5 Drawing Figures

PAINT BRUSH WIPING DEVICE

BACKGROUND OF THE INVENTION

1. Field of the Invention

This invention relates generally to paint brush wiping devices for attachment to and for use with conventional paint cans, and more particularly to a paint brush wiping device that provides an essentially straight wiping edge for a vertically disposed paint brush and that provides first and second fluid flow paths for the return of excess paint to the paint can.

2. Description of the Prior Art

Paint brush wiping devices for use with paint cans have been provided by Saunders, Jr., U.S. Pat. No. 3,744,671 and Levin in U.S. Pat. No. 3,727,792.

The present invention provides advantages over the above-cited prior art in that a straight wiping edge is presented to brushes that are positioned either vertically or on an inclined angle and thereby more uniform wiping of the paint brush is provided than by the aforesaid prior art in which a curved wiping surface was provided for all inclinations of a paint brush except horizontal. The present invention also provides an improvement over the cited art in that paint is kept out of the friction groove of the paint can by a circumferentially disposed friction tongue similar to that of a paint can lid. Further, the present invention provides an improvement over the invention of Saunders, Jr., in that all surfaces are exposed for easy cleaning of the device. Finally, the present invention provides an improvement over the invention of Levin in that a second fluid flow path, for the return to the inside of the paint can of any paint that crosses the wiper blade toward the outside of the can, is provided.

SUMMARY OF THE INVENTION

In accordance with the broader aspects of this invention, there is provided a paint brush wiping device for use with paint cans of the type having a circular lid-attaching portion that comprises inner and outer concentric beads with a circumferential friction groove therebetween. The device comprises a circular rim that includes a circumferential friction tongue for sealably engaging the friction groove of a conventional paint can. This friction tongue provides both an attaching means for attaching the device to a paint can and also a means for sealably excluding paint from the friction groove of the paint can.

The device also includes brush wiper means comprising a wiper blade that is attached to the rim intermediate of the inside bead and that presents a substantially straight wiping edge to a paint brush that is held either vertically or in an inclined position inside the inside bead of the paint can.

The wiper blade is attached to the circular rim by means of a web therebetween; and a brush-opening is provided in the device for insertion of a paint brush into the can, the wiper blade having a wiping edge and being positioned to expose the wiping edge to the brush-opening.

The paint brush wiping device of the present invention also provides first and second fluid flow paths for the return of excess paint to the inside of the paint can. The aforementioned brush-opening provides a first fluid flow path; and a second flow path is provided by a trough in the web intermediate of the wiper blade and a proximal portion of the rim and by a plurality of perforations through the web communicating the trough with the inside of the paint can.

It is an object of the present invention to provide a paint brush wiping device for use with standard paint cans in which the device includes a circumferential friction tongue for sealably engaging the friction groove of the can and for excluding entrance of paint into the friction groove.

It is another object of this invention to provide a paint brush wiping device in which a straight wiping edge is provided for paint brushes which are held either vertically or at an inclined angle.

It is still another object of this invention to provide a paint brush wiping device in which first and second fluid flow paths are provided for return of paint to the paint can.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

Figure 3:
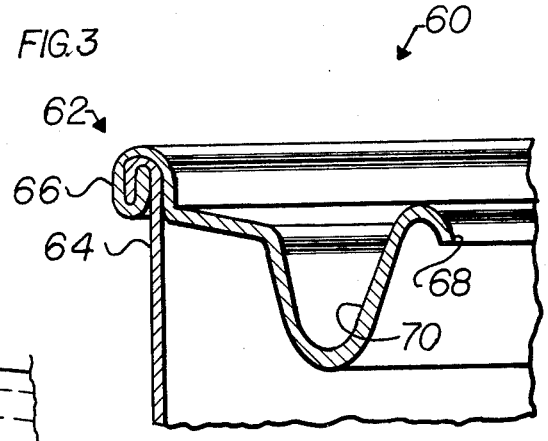
FIG. 3 is a partial cross-sectional elevation of the top of a conventional paint can.
Figure 1:
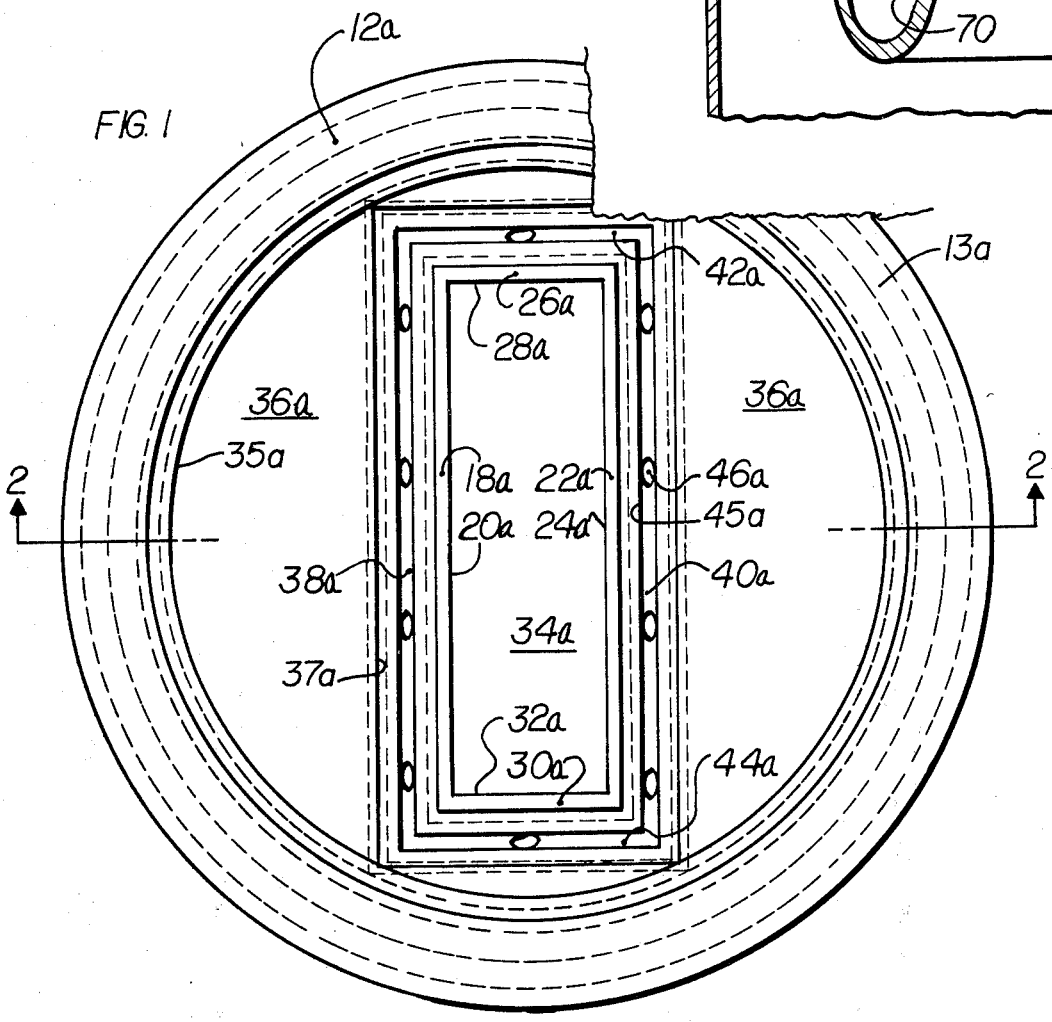
FIG. 1 is a partial top plan view of a first embodiment of the invention.
Figure 2:
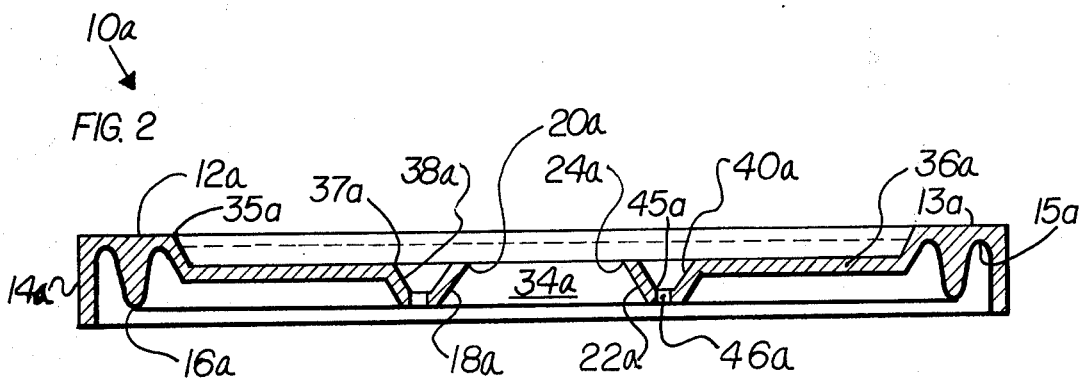
FIG. 2 is a cross-section of FIG. 1; taken substantially as shown by section line 2—2 of FIG. 1.

Referring now to the drawings, and more particularly to FIGS. 1 and 2, a paint brush wiping device, generally indicated at 10*a*, includes a circular rim 12*a*. The circular rim 12*a* includes a circumferential flange 14*a* that serves as an attaching means to attach the device to a conventional paint can such as is shown in FIG. 3. The circular rim 12*a* additionally includes an upper surface 13*a* and a lower surface 15*a*. The circular rim 12*a* also includes a circumferential friction tongue 16*a* that serves as an excluding means to sealably exclude paint from entering into the friction groove of a paint can (FIG. 3). The friction tongue 16*a* also serves, either separately or in cooperation with the flange 14*a*, as an attaching means to attach the device to a conventional paint can.

The device 10*a* includes a first wiper blade 18*a* having a first wiping edge 20*a*, and a second wiper blade 22*a* having a second wiping edge 24*a*, a first auxiliary wiper blade 26*a* having a first auxiliary wiping edge 28*a* and a second auxiliary wiper blade 30*a* having a second auxiliary wiping edge 32*a*. The first wiper blade 18*a* and the second wiper blade 22*a* are disposed in parallel and spaced-apart relationship to each other with the first wiping edge 20*a* and with the second wiping edge 24*a* proximal to each other. In like manner, the first auxiliary wiper blade 26*a* and the second auxiliary wiper blade 30*a* are disposed orthogonally to and at opposite ends of the first wiper blade 18*a* and the second wiper blade 22*a*; so that the auxiliary wiper blades 26*a* and 30*a* serve as first and second brush guides, or guide means, to retain a paint brush (not shown) inside of an inner circumferential bead 68 (FIG. 3) of a conventional paint can 60; and so that all of the wiper blades are disposed in a rectangular pattern to provide a continuous wiping edge that includes the wiping edges 20*a*, 24*a*, 28*a*, and 32*a*; and so that all wiper blades cooperate to form a rectangular brush-opening or third rectangular opening 34*a*. The brush-opening 34*a* provides an opening for inserting and removing a paint brush (not shown) from a paint can (not shown, similar to FIG. 3). The brush-opening 34*a* also provides a first fluid flow path or returning means for returning excess paint to the paint can.

A web 36*a* is disposed in planar relationship to the upper surface 13*a* and the lower surface 15*a*, includes a circular outer periphery 35*a* which is attached to the circular rim 12*a*, and includes a first rectangular opening 37*a*.

The device 10*a* includes a plurality of trough portions 38*a*, 40*a*, 42*a*, and 44*a* which are disposed in a rectangular pattern within the first rectangular opening 37*a* and in conformity thereto and which are attached to respective proximal portions of the first rectangular opening 37*a*.

The trough portions 38*a*, 40*a*, 42*a*, and 44*a* cooperate to provide a second rectangular opening 45*a*. The wiper blades 18*a*, 22*a*, 26*a*, and 30 are interposed into the second rectangular opening 45*a* and are attached to the trough portions 38*a*, 40*a*, 42*a*, and 44*a*, respectively; so that respective ones of the trough portions and the wiper blades cooperate to form four interconnecting and open troughs which open toward the upper surface 13*a*. The trough portions 38*a*, 40*a*, 42*a*, and 44*a*, cooperate with a plurality of apertures 46*a* to provide a second fluid flow path or a returning means for returning excess paint to a paint can.

Referring now to FIG. 3, a conventional paint can, generally depicted at 60, includes a circular lid-attaching portion 62 which is attached to an upright cylindrical portion 64 by an outer cylindrical bead or double seam 66. The lid-attaching portion 62 includes an inner circumferential bead 68 and a circumferential friction groove 70 that is disposed intermediate of the inner circumferential bead 68 and the outer circumferential bead 66. Since paint cans such as the paint can 60 are conventional and highly standardized, the foregoing brief description will suffice.

Figure 4:
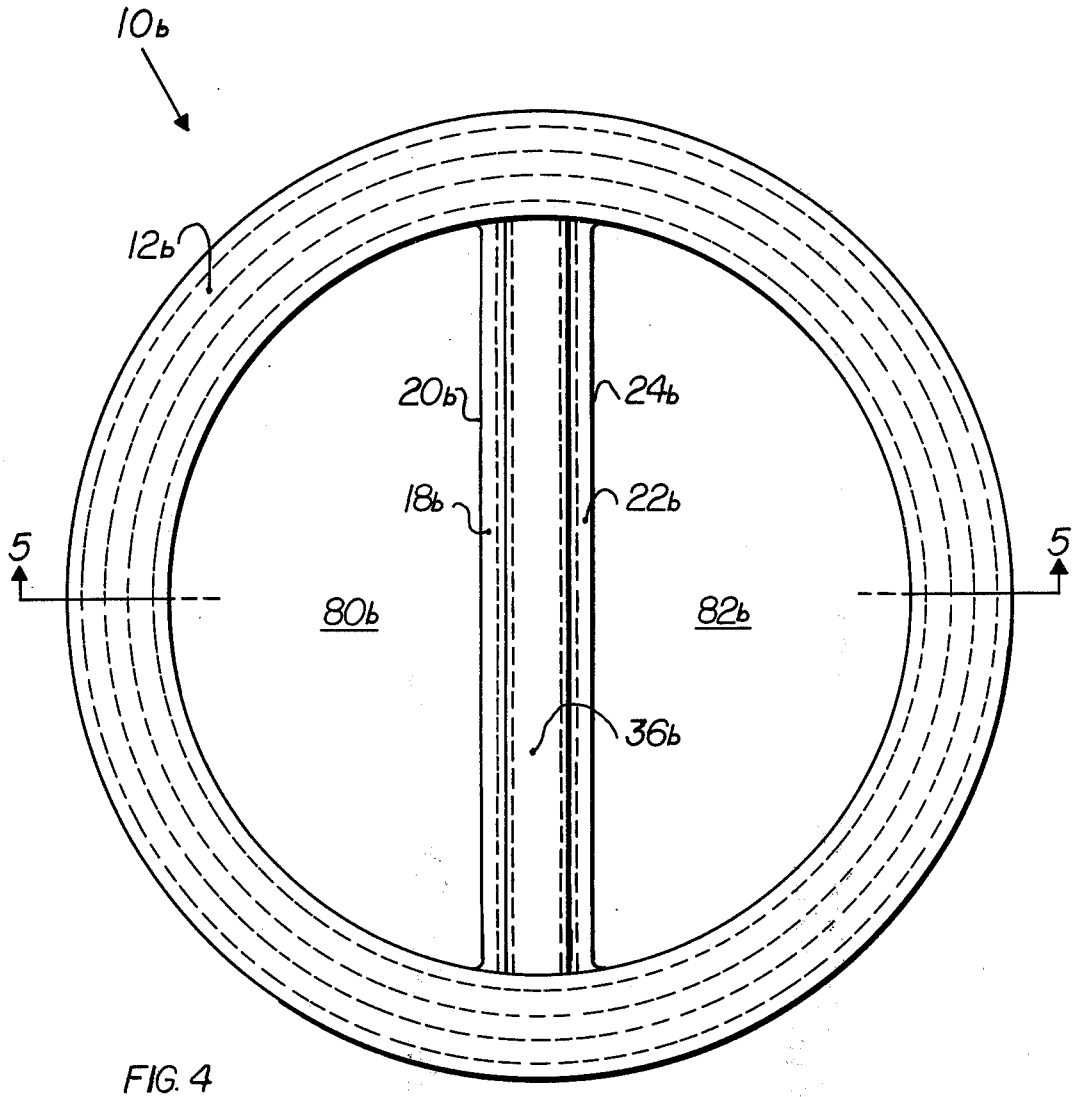
FIG. 4 is a top plan view of a second embodiment of the invention.
Figure 5:
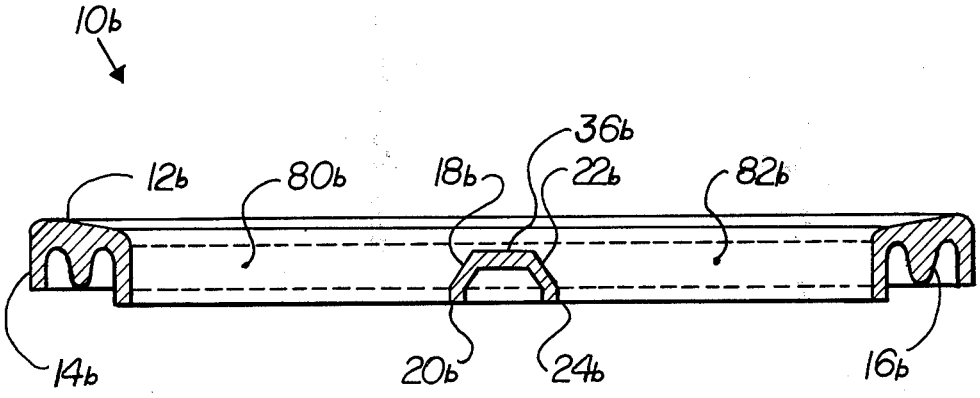
FIG. 5 is a cross-section of the embodiment of FIG. 4, taken substantially as shown by section line 5—5 of FIG. 4.

Referring now to FIGS. 4 and 5, a paint brush wiping device, generally indicated at 10*b*, includes a circular rim 12*b* having a circumferential flange 14*b* which serves as an attaching means to attach the device 10*b* to the can 60 (FIG. 3). The circular rim 12*b* also includes a circumferential friction tongue 16*b* which serves as an excluding means and which, either separately or in cooperation with the flange 14*b*, serves as an attaching means to attach the device 10*b* to the can 60.

The device 10*b* includes a first wiper blade 18*b* having a first wiping edge 20*b*, a second wiper blade 22*b* having a second wiping edge 24*b*, a web 36*b* which interconnects the first wiper blade 18*b* and the second wiper blade 22*b*, a first brush-opening 80*b* which is intermediate of the first wiper blade 18*b* and a proximal portion of the circular rim 12*b*, and a second brush-opening 82*b* which is intermediate of the second wiper blade 22*b* and a proximal portion of the circular rim 12*b*.

Referring again to FIGS. 1 and 2, in operation, a paint brush (now shown) is inserted into the rectangular brush-opening 34*a* and into the paint (not shown) of a paint can (similar to FIG. 3). The paint brush is then removed from the paint and is wiped against one or both of the first and second wiping edges 20*a* and 24*a*. Excess paint from the paint brush is returned to the paint can by way of the brush-opening 34*a* and by way of one or both of the troughs 40*a* and 42*a* and by way of a plurality of the apertures 46*a*.

The auxiliary wiper blades 26*a* and 30*a* serve as a guide means to retain the paint brush within the inner bead 68 of the paint can 60 (FIG. 3). Any paint that may be wiped from the paint brush by the auxiliary wiping edges 28*a* and 32*a* of the wiper blades 26*a* and 30*a* is returned either by means of the first fluid flow path which is provided by the brush-opening 34*a* and/or by the troughs 42*a* and 44*a* and by the apertures 46*a*.

Referring now to FIGS. 4 and 5, in operation, a paint brush (not shown) is inserted through one of the brush-openings, 80*b* or 82*b*, into a paint can (not shown, similar to FIG. 3), and into the paint therein. The paint brush is then removed from the paint and excess paint from the brush is wiped off by means of the first wiping edge 20*b* of the first wiper blade 18*b* and/or by means of the second wiping edge 24*b* of the second wiper blade 22*b*.

It can be seen that, if excess paint is wiped from the paint brush by means of the first wiping edge 20*b* of the first wiper blade 18*b*, then the brush-opening 80*b* serves as a first fluid flow path or returning means for returning excess paint to the can; and, any paint that should happen to cross the web 36*b* is returned to the paint can by the brush-opening 82*b* which then serves as a second fluid flow path or returning means for returning excess paint to the paint can.

In like manner, if excess paint is removed by means of the second wiping edge 24*b* of the second wiper blade 22*b*, then the second brush-opening 82*b* serves as a first fluid flow path or returning means for returning excess paint to the paint can and the first brush-opening 80*b* serves as a second fluid flow path or returning means for returning excess paint to the paint can.

While there have been described above the principles of this invention in connection with specific apparatus, it is to be clearly understood that this description is made only by way of example and not as a limitation to the scope of the invention.

What is claimed is:

1. A paint brush wiping device for use with paint cans of the type having a circular lid-attaching portion that includes inner and outer concentric beads with a circumferential friction groove therebetween, which device comprises:

a. a circular rim having upper and lower surfaces and including circumferential friction tongue means depending from said lower surface for sealably and attachably engaging said friction groove;

b. a web having a circular outer periphery and a first rectangular opening therethrough, being interposed into said rim in planar relationship to said surfaces, and having said outer periphery attached to said rim;

c. four elongated trough portions, being disposed in a rectangular pattern, having outer rectangular dimensions conforming to said first rectangular opening, having a second rectangular opening therethrough intermediate of said four elongated trough portions, being disposed within said first rectangular opening in planar relationship thereto, being attached to said rim proximal to said first rectangular opening, and including perforation means therethrough for the return of fluid from said trough portions to said paint can; and d. wiper blade means, comprising four elongated and substantially straight wiper blades each having an elongated wiping edge, being disposed in a second rectangular pattern, having outer dimensions conforming to said second rectangular opening, having a third rectangular opening therethrough that provides a rectangular paint brush opening with said wiping edges proximal thereto, being disposed within said second rectangular opening in planar relationship thereto, and being attached to respective ones of said trough portions proximal to said second rectangular opening.

2. A paint brush wiping device for use with paint cans of the type having a circular lid-attaching portion that includes inner and outer concentric beads with aa circumferential friction groove therebetween, which device comprises:

a. a circular rim having upper and lower surfaces and including means for removably attaching said rim to said lid-attaching portion and for excluding paint from said friction groove;

b. a pair of elongated and substantially straight wiper blades each having a wiping edge thereupon, being disposed with said wiping edges in spaced-apart proximal relationship to each other, and being disposed intermediate of said rim and in substantially planar relationship to said surfaces;

c. a pair of elongated trough portions each being interposed between one of said wiper blades and a proximal portion of said rim, each being in planar relationship to said surfaces, each being in elongated parallel relationship to said wiper blades, each being attached to the proximal one of said wiper blades, each including perforation means for the return of paint from respective ones of said trough portions to said paint can, and each cooperating with one of said wiper blades to form an open trough that opens toward said upper surfaces; and d. web means, being interposed between said trough portions and said respective proximal portions of said rim and being in substantially planar relationship to said upper and lower surfaces, for securing said wiper blades and said trough portions to said rim.

3. A device as claimed in claim 2 in which said device includes brush guide means, including a first brush guide intermediate said wiper blades at one end thereof and a second brush guide intermediate the other end thereof, for positioning a vertically disposed paint brush inside said rim and spaced therefrom.

4. A device as claimed in claim 2 in which said attaching means comprises a circumferential friction tongue depending from said lower surface.

5. A device as claimed in claim 4 in which said attaching means further comprises a circumferential flange depending from said lower surface and circumscribing said friction tongue at a constant radial distance therefrom.

* * * * *